US006269507B1

(12) United States Patent
DeYoung et al.

(10) Patent No.: US 6,269,507 B1
(45) Date of Patent: Aug. 7, 2001

(54) DETERGENT INJECTION SYSTEMS FOR CARBON DIOXIDE CLEANING APPARATUS

(75) Inventors: James P. DeYoung; Timothy J. Romack, both of Durham; James B. McClain, Raleigh, all of NC (US)

(73) Assignee: MiCell Technologies, Inc., Raleigh, NC (US)

( * ) Notice: Subject to any disclaimer, the term of this patent is extended or adjusted under 35 U.S.C. 154(b) by 0 days.

(21) Appl. No.: 09/467,656

(22) Filed: Dec. 20, 1999

Related U.S. Application Data

(62) Division of application No. 09/312,556, filed on May 14, 1999.

(51) Int. Cl.[7] ..... D06F 39/02
(52) U.S. Cl. ..... 8/158; 8/159; 69/182
(58) Field of Search ..... 68/18 R, 18 C; 8/142, 158, 159; 134/10, 12

(56) References Cited

U.S. PATENT DOCUMENTS

| | | | | |
|---|---|---|---|---|
| 3,653,234 | | 4/1972 | Gillespie | 68/12 R |
| 5,213,619 | | 5/1993 | Jackson et al. | 134/1 |
| 5,267,455 | | 12/1993 | Dewees et al. | 68/5 |
| 5,412,958 | | 5/1995 | Iliff et al. | 68/5 |
| 5,467,492 | | 11/1995 | Chao et al. | 8/159 |
| 5,669,251 | | 9/1997 | Townsend et al. | 68/58 |
| 5,683,977 | | 11/1997 | Jureller et al. | 510/286 |
| 5,784,905 | | 7/1998 | Townsend et al. | 68/13 R |
| 5,822,818 | | 10/1998 | Chao et al. | 8/158 |
| 5,904,737 | | 5/1999 | Preston et al. | 8/158 |
| 5,943,721 | | 8/1999 | Lerette et al. | 8/158 |
| 5,953,780 | | 9/1999 | Schollmeyer et al. | 8/158 |
| 5,968,202 | * | 10/1999 | Verbiest et al. . | |
| 5,970,554 | | 10/1999 | Shore et al. | 8/158 |
| 6,045,588 | * | 4/2000 | Estes et al. . | |
| 6,073,292 | * | 6/2000 | Lindqvist et al. . | |
| 6,114,295 | * | 9/2000 | Murphy . | |
| 6,129,451 | * | 10/2000 | Rosio . | |

FOREIGN PATENT DOCUMENTS

| | | | |
|---|---|---|---|
| WO 97/33031 | 9/1997 | (WO) . | |
| WO99/10587 | 3/1999 | (WO) | D06L/1/04 |
| WO99/34937 | 7/1999 | (WO) . | |
| WO 99/49122 | 9/1999 | (WO) . | |

* cited by examiner

*Primary Examiner*—Frankie L. Stinson
(74) *Attorney, Agent, or Firm*—Myers Bigel Sibley & Sajovec

(57) ABSTRACT

A system for the controlled addition of detergent formulations and the like to a carbon dioxide cleaning apparatus comprises: (a) a high pressure wash vessel; (b) an auxiliary vessel; (c) a drain line connecting the auxiliary vessel to the wash vessel; (d) optionally but preferably, a separate vent line connecting the auxiliary vessel to the wash vessel; (e) a detergent reservoir; and (f) a detergent supply line connecting the detergent reservoir to the auxiliary vessel. An advantage of this apparatus is that, because the detergent formulation can be pumped into the auxiliary vessel in a predetermined aliquot or amount, which predetermined aliquot or amount can then be transferred into the wash vessel where it combines with the liquid carbon dioxide cleaning solution, the detergent formulation can be added to the cleaning solution in a more controlled or accurate manner. An alternate embodiment adapted for the addition of aqueous detergent formulations and the like to a carbon dioxide dry cleaning system under turbulent conditions comprises: (a) a high pressure wash vessel; (b) a filter; (c) a carbon dioxide cleaning solution drain line interconnecting the wash vessel to the filter; (d) a carbon dioxide cleaning solution supply line connecting the filter to the wash vessel; (e) a first high pressure pump (i.e., a pump that is capable of pumping liquid solutions comprising liquid carbon dioxide) operably connected to the drain line; (f) a detergent formulation reservoir; (g) a detergent formulation supply line connecting the reservoir to the carbon dioxide cleaning solution supply line; and (h) a second high pressure pump operably connected to the detergent formulation supply line for transferring detergent formulation from the detergent formulation reservoir into the carbon dioxide cleaning solution under turbulent conditions.

10 Claims, 3 Drawing Sheets

DETERGENT INJECTION SYSTEMS FOR CARBON DIOXIDE CLEANING APPARATUS

A Divisional of prior application Ser. No. 09/312,556; filed May 14, 1999.

FIELD OF THE INVENTION

The present invention relates to methods for carrying out the dry cleaning of fabrics (e.g., garments) in liquid carbon dioxide, and particularly relates to methods and apparatus for adding detergent formulations to liquid carbon dioxide dry cleaning systems.

BACKGROUND OF THE INVENTION

Many traditional solvent-based cleaning applications can suffer from poor performance on aqueous born soils. A significant portion of the soils found in conventional dry cleaning can be categorized as partially or wholly water-soluble. Water-in-oil surfactants have been developed that effectively disperse water to yield optically clear homogeneous mixtures. These dispersions can effectively dissolve water-soluble soils, termed secondary solublization, if the proper water activity is achieved in a given cleaning solvent. Water activity, determined by a number of factors including temperature, the nature of solvent-solute interactions and the molar ratio of surfactant to water, is generally monitored in conventional dry cleaning by what is termed as relative humidity. A cleaning bath with low relative humidity and hence low water activity will not allow for secondary solublization of aqueous born soils. Water exceeding a critical level can lead to non-dispersed bulk water that can be deleterious to certain garment types.

Carbon dioxide based dry cleaning is a new technology that has only recently been commercially implemented. Like conventional dry cleaning solvents water-soluble soils are not inherently soluble in liquefied carbon dioxide. Surfactant systems that enable the water bearing nature of liquid carbon dioxide have been disclosed in the patent and open literature. Under certain conditions these systems have demonstrated that water-soluble materials can be dissolved and dispersed in a liquid carbon dioxide medium.

Many conventionally used water-in-oil surfactants applied to dry cleaning solvents are not compatible with liquid $CO_2$ solvent systems. Surfactants containing what is termed to be "$CO_2$-philic" function have been proven to be useful in the emulsification of water in $CO_2$. The exclusive use of some of these materials can be cost prohibitive for many applications. The case for dissolution of water-soluble materials in $CO_2$ can be further complicated by the reversible reaction between water and carbon dioxide producing carbonic acid. This weak acid which reverts back to water and carbon dioxide as pressure is lowered and $CO_2$ is removed can have substantial implications on water activity in $CO_2$. Lower water activity can effect the ability of the $CO_2$ cleaning fluid to dissolve water-soluble soils. Certain pH buffers have been used in liquid and supercritical $CO_2$ to control the pH of aqueous micro and macro-domains and in turn augment water activity. Attempts to raise the water activity in current processes by the addition of bulk water can fail because of the inability of the $CO_2$ and surfactant combinations to sufficiently stabilize the water. Bulk water phase-separated from liquid $CO_2$ cleaning fluids and conventional cleaning fluids can have substantial detrimental effects on many dry clean only fabrics.

Not all stains are water soluble. Indeed, a significant number of stains that must be cleaned in a dry cleaning operation are hydrophobic. Thus, in addition to aqueous detergent formulations, it is also desirable to have a means for adding low water content detergent formulations to carbon dioxide dry cleaning systems.

U.S. Pat. No. 5,858,022 to Romack et al. and U.S. Pat. No. 5,683,473 to Jureller et al. (see also U.S. Pat. No. 5,683,977 to Jureller et al.) describe carbon dioxide dry cleaning methods and compositions. Our co-pending U.S. patent application Ser. No. 09/047,013 of McClain et al., filed Mar. 24, 1998, describes carbon dioxide dry cleaning apparatus. Dry cleaning apparatus is also described in U.S. Pat. No. 5,467,492 to Chao et al. U.S. Pat. No. 5,651,276 to Purer et al., and U.S. Pat. No. 5,784,905 to Townsend et al. It will be seen that there is a need for better ways to add detergent formulations to the carbon dioxide during operation of the apparatus.

SUMMARY OF THE INVENTION

A first aspect of the present invention is system for the controlled addition of detergent formulations and the like to a carbon dioxide cleaning apparatus. The system preferably comprises:

(a) a high pressure wash vessel;

(b) an auxiliary vessel;

(c) a drain line connecting the auxiliary vessel to the wash vessel;

(d) optionally but preferably, a separate vent line connecting the auxiliary vessel to the wash vessel;

(e) a detergent reservoir; and (f) a detergent supply line connecting the detergent reservoir to the auxiliary vessel.

An advantage of this apparatus is that, because the detergent formulation can be pumped into the auxiliary vessel in a predetermined aliquot or amount, which predetermined aliquot or amount can then be transferred into the wash vessel where it combines with the liquid carbon dioxide cleaning solution, the detergent formulation can be added to the cleaning solution in a more controlled or accurate manner.

A second aspect of the present invention is a method for the controlled addition of a low-water content detergent formulation or the like (e.g., a starch or size formulation) to a carbon dioxide dry cleaning system. The method may be carried. The method comprises:

(a) providing a carbon dioxide cleaning apparatus comprising a wash vessel and a separate auxiliary vessel;

(b) reducing the pressure in the wash vessel and the auxiliary vessel; then (c) adding a detergent formulation to the auxiliary vessel, the detergent (c) formulation comprising (i) at least 30 percent organic co-solvent, (ii) at least 1 percent surfactant; and (ii) not more than 10 percent water (and preferably less than 10 percent water); then (d) increasing the pressure in the wash vessel so that liquid carbon dioxide can be pumped therethrough to clean articles in the wash vessel; and then (e) transferring the detergent formulation from the auxiliary vessel to the wash vessel to facilitate the cleaning of articles therein.

A third aspect of the present invention is a system for the addition of aqueous detergent formulations and the like to a carbon dioxide dry cleaning system under turbulent conditions. The system preferably comprises:

(a) a high pressure wash vessel;

(b) a filter;

(c) a carbon dioxide cleaning solution drain line interconnecting the wash vessel to the filter;

(d) a carbon dioxide cleaning solution supply line connecting the filter to the wash vessel;

(e) a first high pressure pump (i.e., a pump that is capable of pumping liquid solutions comprising liquid carbon dioxide) operably connected to the drain line;

(f) a detergent formulation reservoir;

(g) a detergent formulation supply line connecting the reservoir to the carbon dioxide cleaning solution supply line; and (h) a second high pressure pump operably connected to the detergent formulation supply line for transferring detergent formulation from the detergent formulation reservoir into the carbon dioxide cleaning solution under turbulent conditions.

An advantage of this apparatus is that it provides for the introduction of detergent formulations and the like under turbulent conditions, which facilitates the mixing of the formulations with the liquid carbon dioxide wash solution. Such a manner of introduction is particularly advantageous when the detergent formulation is immiscible, wholly or in part, with the liquid carbon dioxide wash solution.

A fourth aspect of the present invention is a method for the addition of aqueous detergent formulations and the like to a carbon dioxide dry cleaning system under turbulent conditions. The method may be carried out with an apparatus as described immediately above. The method comprises:

(a) providing a carbon dioxide cleaning apparatus comprising a wash vessel and a filter;

(b) pumping a continuous stream of liquid carbon dioxide cleaning solution from the wash vessel through the filter and back to the wash vessel to clean articles in the wash vessel; and (c) adding a detergent formulation into the continuous stream of liquid carbon dioxide at a point downstream of the filter and upstream of the wash vessel to introduce the detergent formulation into the continuous stream, with the detergent formulation comprising (i) at least 10 or preferably at least 20 percent water, and (ii) at least 1 percent surfactant, so that water in the detergent formulation is dispersed in the liquid carbon dioxide prior to entry into the wash vessel, without depletion in the filter.

The systems described above may be provided independently on a cleaning apparatus, or may be combined together on a cleaning apparatus to provide the capability of both manners of detergent introduction.

DETAILED DESCRIPTION OF THE INVENTION

Figure 1:
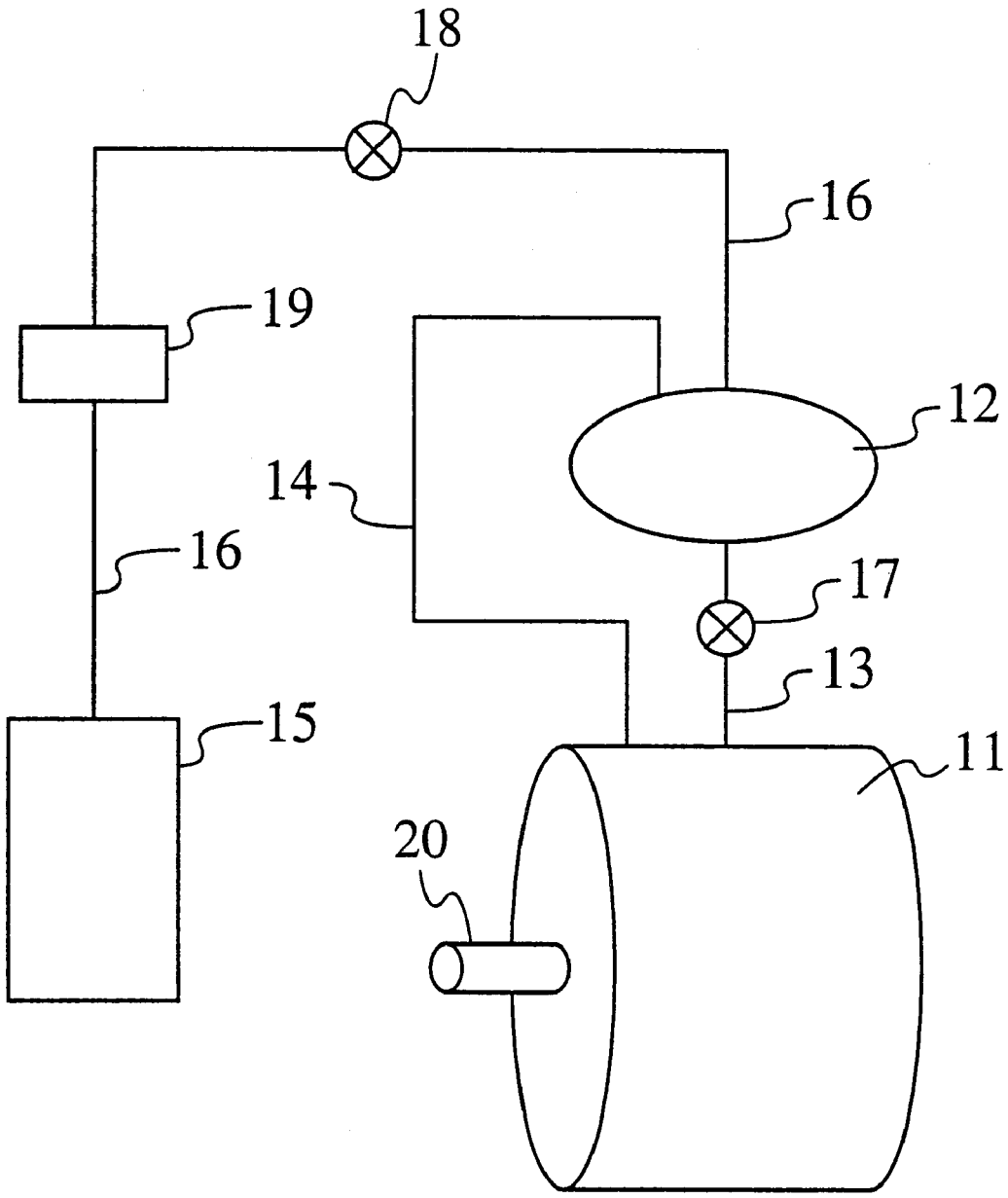
FIG. 1 schematically illustrates an apparatus for the controlled introduction of detergent formulations into the wash vessel of a carbon dioxide cleaning apparatus.

The term "clean" as used herein refers to any removal of soil, dirt, grime, or other unwanted material, whether partial or complete. The invention may be used to clean nonpolar stains (i.e., those which are at least partially made by nonpolar organic compounds such as oily soils, sebum and the like), polar stains (i.e., hydrophilic stains such as grape juice, coffee and tea stains), compound hydrophobic stains (i.e., stains from materials such as lipstick and candle wax), and particular soils (i.e., soils containing insoluble solid components such as silicates, carbon black, etc.).

Articles that can be cleaned by the method of the present invention are, in general, garments and fabrics (including woven and non-woven) formed from materials such as cotton, wool, silk, leather, rayon, polyester, acetate, fiberglass, furs, etc., formed into items such as clothing, work gloves, rags, leather goods (e.g., handbags and brief cases), etc.

Detergent formulations described herein are combined with liquid carbon dioxide (which may also contain surfactants and other previously added ingredients) to provide liquid carbon dioxide-based dry cleaning compositions. Such compositions typically comprise:

(a) from zero, 0.02, 0.05 or 0.1 to 5 or 10 percent (more preferably from 0.1 to 4 percent) water;

(b) carbon dioxide (to balance; typically at least 30 percent);

(c) surfactant (preferably from 0.1 or 0.5 percent to 5 or 10 percent total, which may be comprised of one or more different surfactants); and (d) from 0.1 to 50 percent (more preferably 1, 2 or 4 percent to 30 percent) of an organic co-solvent.

Percentages herein are expressed as percentages by weight unless otherwise indicated. The composition is provided in liquid form at ambient, or room, temperature, which will generally be between zero and 50° Centigrade. The composition is held at a pressure that maintains it in liquid form within the specified temperature range. The cleaning step is preferably carried out with the composition at ambient temperature.

1. Organic Co-Solvents.

The organic co-solvent is, in general, a hydrocarbon co-solvent. Typically the co-solvent is an alkane co-solvent, with $C_{10}$ to $C_{20}$ linear, branched, and cyclic alkanes, and mixtures thereof (preferably saturated) currently preferred. The organic co-solvent preferably has a flash point above 140° F., and more preferably has a flash point above 170° F. The organic co-solvent may be a mixture of compounds, such as mixtures of alkanes as given above, or mixtures of one or more alkanes. Additional compounds such as one or more alcohols (e.g., from 0 or 0.1 to 5% of a C1 to C15 alcohol (including diols, triols, etc.)) different from the organic co-solvent may be included with the organic co-solvent.

Examples of suitable co-solvents include, but are not limited to, aliphatic and aromatic hydrocarbons, and esters and ethers thereof, particularly mono and di-esters and ethers (e.g., EXXON ISOPAR L, ISOPAR M, ISOPAR V, EXXON EXXSOL, EXXON DF 2000, CONDEA VISTA LPA-170N, CONDEA VISTA LPA-210, cyclohexanone, and dimethyl succinate), alkyl and dialkyl carbonates (e.g., dimethyl carbonate, dibutyl carbonate, di-t-butyl dicarbonate, ethylene carbonate, and propylene carbonate), alkylene and polyalkylene glycols, and ethers and esters thereof (e.g., ethylene glycol-n-butyl ether, diethylene glycol-n-butyl ethers, propylene glycol methyl ether, dipropylene glycol methyl ether, tripropylene glycol methyl ether, and dipropylene glycol methyl ether acetate), lactones (e.g. (gamma) butyrolactone, (epsilon) caprolactone, and (delta)

dodecanolactone), alcohols and diols (e.g., 2-propanol, 2-methyl-2-propanol, 2-methoxy-2-propanol, 1-octanol, 2-ethyl hexanol, cyclopentanol, 1,3-propanediol, 2,3-butanediol, 2-methyl-2,4-pentanediol) and polydimethylsiloxanes (e.g., decamethyltetrasiloxane, decamethylpentasiloxane, and hexamethyldisloxane), etc.

2. Surfactants.

Any surfactant can be used to carry out the present invention, including both surfactants that contain a $CO_2$-philic group (such as described in PCT Application WO96/27704) linked to a $CO_2$-phobic group (e.g., a lipophilic group) and (more preferably) conventional surfactants, or surfactants that do not contain a $CO_2$-philic group (i.e., surfactants that comprise a hydrophilic group linked to a hydrophobic typically lipophilic) group). A single surfactant may be used, or a combination of surfactants may be used.

Numerous surfactants are known to those skilled in the art. See, e.g., McCutcheon's Volume 1: Emulsifiers & Detergents (1995 North American Edition) (MC Publishing Co., 175 Rock Road, Glen Rock, N.J. 07452). Examples of the major surfactant types that can be used to carry out the present invention include the: alcohols, alkanolamides, alkanolamines, alkylaryl sulfonates, alkylaryl sulfonic acids, alkylbenzenes, amine acetates, amine oxides, amines, sulfonated amines and amides, betaine derivatives, block polymers, carboxylated alcohol or alkylphenol ethoxylates, carboxylic acids and fatty acids, diphenyl sulfonate derivatives, ethoxylated alcohols, ethoxylated alkylphenols, ethoxylated amines and/or amides, ethoxylated fatty acids, ethoxylated fatty esters and oils, fatty esters, fluorocarbon-based surfactants, glycerol esters, glycol esters, hetocyclic-type products, imidazolines and imidazoline derivatives, isethionates, lanolin-based derivatives, lecithin and lecithin derivatives, lignin and lignin derivatives, maleic or succinic anhydrides, methyl esters, monoglycerides and derivatives, olefin sulfonates, phosphate esters, phosphorous organic derivatives, polyethylene glycols, polymeric (polysaccharides, acrylic acid, and acrylamide) surfactants, propoxylated and ethoxylated fatty acids alcohols or alkyl phenols, protein-based surfactants, quaternary surfactants, sarcosine derivatives, silicone-based surfactants, soaps, sorbitan derivatives, sucrose and glucose esters and derivatives, sulfates and sulfonates of oils and fatty acids, sulfates and sulfonates, ethoxylated alkylphenols, sulfates of alcohols, sulfates of ethoxylated alcohols, sulfates of fatty esters, sulfonates of benzene, cumene, toluene and xylene, sulfonates of condensed naphthalenes, sulfonates of dodecyl and tridecylbenzenes, sulfonates of naphthalene and alkyl naphthalene, sulfonates of petroleum, sulfosuccinamates, sulfosuccinates and derivatives, taurates, thio and mercapto derivatives, tridecyl and dodecyl benzene sulfonic acids, etc.

Additional examples of surfactants that can be used to carry out the present invention include alcohol and alkylphenol polyalkyl ethers(e.g., TERGITOL 15-S-3™ secondary alcohol ethoxylate, TRITON X-207™ dinonylphenol ethoxylate, NEODOL 91-2.5™ primary alcohol ethoxylate, RHODASURF BC-410™ isotridecyl alcohol ethoxylate, RHODASURF DA-630™ tridecyl alcohol ethoxylate) alkylaryl carbonates, including salts and derivatives thereof (e.g., acetic acid, MARLOWET 4530™ dialkylphenol polyethylene glycol acetic acid, MARLOWET 1072™ alkyl polyethylene glycol ether acetic acid), alkoxylated fatty acids (e.g., NOPALCOL 1-TW™ diethylene glycol monotallowate, TRYDET 2600™ polyoxyethylene (8) monostearate), alkylene oxide block copolymers (e.g., PLURONIC™ and TETRONIC™ products), acetylenic alcohols and diols (e.g., SURFYNOL™ and DYNOL™ products), mono- and di-esters of sulfosuccinic acid (e.g., AEROSOL OT™ sodium dioctyl sulfosuccinate, AEROSOL IB-45™ sodium diisobutyl sulfosuccinate, MACKANATE DC-50™ dimethicone copolyol disodium sulfosuccinate, SOLE TERGE-8™ oleic acid isopropanolamide monoester of sodium sulfosuccinate), sulfosuccinamic acid and esters thereof (e.g. AEROSOL 18™ disodium-N-octadecyl sulfosucciniamate, AEROSOL 22™ tetrasodium N-(1,2-dicarboxyethyl)-N octadecyl sulfosuccinamate) sorbitan esters including derivatives thereof (e.g., SPAN 80™ sorbitan monoleate, ALKAMULS 400-DO™ sorbitan dioleate, ALKAMULS STO™ sorbitan trioleate, TWEEN 81™ polyoxyethylene (5) sorbitan monoleate, TWEEN 21™ polyoxyethylene (4) sorbitan monolaurate), isothionates including derivatives thereof (e.g., GEROPON AC-270™ sodium cocoyl isothionate), polymeric alkylaryl compounds and lignins, including derivatives thereof (e.g., LIGNOSITE 50 calcium lignosulfonate), alkylaryl sulfonic acids and salts thereof (e.g., CALIMULSE EM-99™ branched dodecylbenzene sulfonic acid, WITCONATE C-50H™ sodium dodecylbenzene sulfonate, WITCONATE P10-59™ amine salt of dodecylbenzene sulfonate), sulfonated amines and amides (e.g., CALIMULSE PRS™ isopropylamine sulfonate), Betaine and sultaine derivatives, and salts thereof (e.g., lauryl sulfobetaine, dodecyldimethyl(3-sulfopropyl)ammonium hydroxide, FOAMTAIN CAB-A™ cocamidopropyl betaine ammonium salt, FOAMTAINE SCAB™ cocamidopropyl hydroxy sultaine), e.g., imidazolines including derivatives thereof (e.g., MONOAZOLINE O™ substituted imidazoline of oleic acid, MONOAZOLINE T™ substituted imidazoline of Tall Oil), oxazolines including derivatives thereof (e.g., ALKATERGE E™ oxazoline derivative, ALKATERGE T-IV™ ethoxylated oxazoline derivative), carboxylated alcohol or alkylphenol ethoxylates including derivatives thereof (e.g., MARLOSOL OL7™ oleic acid polyglycol ester), diphenyl sulfonates including derivatives thereof (e.g., DOWFAX™ detergent diphenyl oxide disulfonate, DOWFAX™ dry detergent: sodium n-hexadecyl diphenyl oxide disulfonate, DOWFAX™ Dry hydrotrope: sodium hexyl diphenyloxide disulfonate) fluorinated surfactants (e.g., FLUORAD FC-120™ ammonium perfluoroalkyl sulfonate, FLUORAD FC-135™ fluoroalkyl quaternary ammonium iodides, FLUORAD FC-143™ ammonium perfluoroalkyl carboxylates), lecithis including lecithin derivatives (e.g., ALCOLEC BS™ soy phosphatides), phosphate esters (e.g. ACTRAFOS SA-216™ aliphatic phosphate ester, ACTRAFOS 110™ phosphate ester of complex aliphatic hydroxyl compound, CHEMPHOS TC-310™ aromatic phosphate ester, CALGENE PE-112N™ phosphated mono- and diglycerides), sulfates and sulfonates of fatty acids (e.g., ACTRASOL PSR™ sulfated castor oil, ACTRASOL SR75™ sulfated oleic acid), sulfates of alcohols (e.g., DUPONOL C™ sodium lauryl sulfate, CARSONOL SHS™ sodium 2-ethyl-1-hexyl sulfate, CALFOAM TLS-40™ triethanolamine lauryl sulfate), sulfates of ethoxylated alcohols (e.g., CALFOAM ES-301™ sodium lauryl ether sulfate), amines, including salts and derivatives thereof (e.g., Tris(hydroxymethyl)aminomethane, ARMEEN™ primary alkylamines, ARMAC HT™ acetic acid salt of N-allyl amines) amide sulfonates (e.g., GEROPON TC-42™ sodium N-coconut acid-N-methyl taurate, GEROPON TC 270™ sodium cocomethyl tauride), quaternary amines, including salts and derivatives thereof (e.g. ACCOSOFT 750™ methyl bis (soya amidoethyl)-N-polyethoxyethanol quaternary ammonium methyl sulfate, ARQUAD™ N-alkyl trimethyl ammonium chloride, ABIL QUAT 3272™ diquaternary polydimethylsiloxane), amine oxides (e.g., AMM- ONYX CO™ cetyl dimethylamine oxide, AMMONYX SO™ stearamine oxide), esters of glycerol, sucrose, glucose, sarcosine and related sugars and hydrocarbons including their derivatives (e.g., GLUCATE DO™ methyl glucoside dioleate, GLICEPOL 180™ glycerol oleate, HAMPOSYL AL-30™ ammonium lauroyl sarcosinate, HAMPOSYL M™ N-myristoyl sarcosine, CALGENE CC™ propylene glycol dicaprylate/dicaprate), polysaccharides including derivatives thereof (e.g., GLUCOPON 225 DK™ alkyl polysaccharide ether), protein surfactants (e.g., AMITER LGS-2™ dioxyethylene stearyl ether diester of N-lauroyl-L-glutamic acid, AMISOFT CA™ cocoyl glutamic acid, AMISOFT CS 11™ sodium cocoyl glutamate, MAYTEIN KTS™ sodium/TEA lauryl hydrolyzed keratin, MAYPON 4C™ potassium cocoyl hydrolyzed collagen), and including thio and mercapto derivatives of the foregoing (e.g., ALCO-DET™ polyoxyethylene thioether, BURCO TME™ ethoxylated dodecyl mercaptan), etc.

Thus the present invention may be carried out using conventional surfactants, including but not limited to the anionic or nonionic alkylbenzene sulfonates, ethoxylated alkylphenols and ethoxylated fatty alcohols described in Schollmeyer German Patent Application DE 39 04514 A1, that are not soluble in liquid carbon dioxide and which could not be utilized in the invention described in U.S. Pat. No. 5,683,473 to Jureller et al. or U.S. Pat. No. 5,683,977 to Jureller et al.

As will be apparent to those skilled in the art, numerous additional ingredients can be included in the detergent formulations, including whiteners, softeners, sizing, starches, enzymes, hydrogen peroxide or a source of hydrogen peroxide, fragrances, etc.

3. Cleaning Apparatus.

Any suitable cleaning apparatus may be employed, including both horizontal drum and vertical drum apparatus. When the drum is a horizontal drum, the agitating step is carried out by simply rotating the drum. When the drum is a vertical drum it typically has an agitator positioned therein, and the agitating step is carried out by moving (e.g., rotating or oscillating) the agitator within the drum. A vapor phase may be provided by imparting sufficient shear forces within the drum to produce cavitation in the liquid dry-cleaning composition.

U.S. Pat. No. 5,858,022 to Romack et al. and U.S. Pat. No. 5,683,473 to Jureller et al. (see also U.S. Pat. No. 5,683,977 to Jureller et al.) describe carbon dioxide dry cleaning methods and compositions which may be used to carry out the present invention. All issued and pending United States Patent references referred to herein are to be incorporated by reference herein in their entirety.

Our co-pending U.S. patent application Ser. No. 09/047,013 of McClain et al., filed Mar. 24, 1998, describes carbon dioxide dry cleaning apparatus that may be used to carry out the present invention.

In an alternate embodiment of the invention, agitation may be imparted by means of jet agitation as described in U.S. Pat. No. 5,467,492 to Chao et al., the disclosure of which is incorporated herein by reference. As noted above, the liquid dry cleaning composition is preferably an ambient temperature composition, and the agitating step is preferably carried out at ambient temperature, without the need for associating a heating element with the cleaning apparatus.

Finally, dry cleaning apparatus that may be used to carry out the present invention is also described in U.S. Pat. No. 5,651,276 to Purer et al. and U.S. Pat. No. 5,784,905 to Townsend et al.

4. Low-Water Detergent Formulations.

As noted above, in one embodiment of the invention the detergent formulation is low in water content, or substantially nonaqueous. Preferred low-water content detergent formulations for carrying out the present invention typically comprise, by weight:

(a) at least 10 percent organic co-solvent (and preferably at least 40, 50, 60 or 80 percent organic co-solvent or more, up to 99 percent organic co-solvent or more) (which may be one or more organic solvents);

(b) at least 0.1 percent surfactant (preferably 1, 2 or 4 to 5, 10 or 15 percent surfactant or more); and (c) not more than 5 or 10 percent water. In some cases, the formulation may be free of water (or non-aqueous), or may contain up to not more than 1, 2, 3 or 4 percent water.

Additional adjuncts useful in these formulations include whiteners, brighteners, fragrances, sizing agents, coatings, pH buffers, bleaches, enzymes, alcohols, peroxides, softeners, etc.

5. Apparatus for Adding Low-Water Detergent Formulations.

As noted above, the present invention provides a system for the controlled addition of detergent formulations and the like to a carbon dioxide cleaning apparatus. As illustrated in FIG. 1, the system preferably comprises a high pressure wash vessel 11 (i.e., a wash vessel that is capable of containing liquid carbon dioxide), an auxiliary vessel 12, and a drain line 13 connecting the auxiliary vessel to the wash vessel. The auxiliary vessel is positioned above the wash vessel so that the contents of the auxiliary vessel can be transferred by gravity to the wash vessel. Alternatively the auxiliary vessel could be positioned below the wash vessel and the contents thereof transferred to the wash vessel by means of a pump. Optionally, but preferably, a vent line 14 connects the auxiliary vessel to the wash vessel to provide gas-side communication therebetween (i.e., the point of connection of the vent line to each vessel is above the liquid-fill level therein). This facilitates the transfer of the contents of the auxiliary vessel to the wash vessel.

A detergent reservoir 15 is provided, and a detergent supply line 16 is provided connecting the detergent reservoir to the auxiliary vessel. Valves 17, 18 are provided to control the system, as discussed in greater detail below.

A pump 19, which is preferably an inexpensive, low pressure pump, is provided to fill the auxiliary vessel from the detergent reservoir. Other mechanisms could also be employed. For example, the detergent reservoir could be positioned above the auxiliary vessel and the auxiliary vessel gravity filled from the reservoir.

The wash vessel may contain a rotating basket driven by any suitable drive means 20, including but not limited to a turbine drive, a direct motor drive, an internal or external electric motor, etc. Drive mechanisms are discussed in greater detail in the patents and patent applications referenced above.

In operation, the aforesaid apparatus provides a method for the controlled addition of a low-water content detergent formulation or the like (e.g., a starch or size formulation) to a carbon dioxide dry cleaning system. In general, valve 17 is closed to fill the auxiliary vessel and opened to empty the auxiliary vessel into the wash tank. Valve 18 is opened to fill the auxiliary vessel, but closed when the pressure in the wash tank is increased to prevent back pressure from reaching the detergent reservoir. The method involves, initially, reducing the pressure in the wash vessel and the auxiliary vessel. The pressure may be wholly or partially reduced, but is preferably reduced to atmospheric pressure at the time the wash vessel is opened to remove articles such as clothing or fabric therein and/or insert new articles to be cleaned. Then, a detergent formulation or the like such as described above or below (and preferably a formulation that does not contain more than 10 percent water), is transferred into the auxiliary vessel from reservoir 15 by means of pump 19. Preferably, the pressure in the wash vessel is then increased so that liquid carbon dioxide can be pumped therethrough to clean articles in the wash vessel. The detergent formulation is then transferred from the auxiliary vessel to the wash vessel to facilitate the cleaning of articles therein. Liquid carbon dioxide cleaning solution can be separately pumped into and/or cycled through the wash vessel, before or after the detergent formulation has been transferred from the auxiliary vessel to the wash vessel 6. Aqueous Detergent Formulations.

As noted above, the present invention discloses aqueous based detergent compositions and their method of introduction into liquid carbon dioxide dry cleaning machines. The composition and method of application of these materials provides for improved water-soluble cleaning in carbon dioxide dry cleaning machines. These compositions are to be injected automatically or by choice into liquid carbon dioxide wash fluid during a cleaning cycle which may or may not contain surfactants, co-solvents, and other adjuncts previously disclosed. The method of injection is important in determining the effectiveness of the aqueous cleaning, as is the composition of the injected detergent.

The composition of the useful detergents is generally aqueous in nature with water representing between 5 and 100% of the injected material, preferably between 50 and 98%. Formulations also contain surfactants that help disperse water once injected into the $CO_2$ wash fluid, help wet the surface of the articles to be cleaned, help lower static interactions between soil and items to be cleaned, or help deplete water at the surface of items to be cleaned. Useful surfactant levels are between 0 and 20%, preferably between 0 and 5%. The formulations may also contain co-solvents useful in modifying the solvent power of the $CO_2$, useful in quantities between 0 and 90%, more useful between 0 and 30%.

Preferred aqueous detergent formulations for carrying out the present invention typically comprise, by weight:

(a) at least 10 percent water (and preferably at least 40, 50, 60 or 80 percent water or more, up to 99 percent water or more);

(b) at least 0.1 percent surfactant (preferably 1, 2 or 4 to 5, 10 or 15 percent surfactant or more); and (c) from zero, 1 or 2 to 5, 10, 20 or 40 percent of an organic co-solvent.

Additional adjuncts useful in these formulations include whiteners, brighteners, alcohols, fragrances, sizing agents, coatings, pH buffers, bleaches, enzymes, peroxides, softeners, etc.

7. Apparatus for Adding Aqueous Detergent Formulations.

In general, the desired mode of injection into the machine is carried out during the cleaning cycle. It is important that the addition of the detergent is accomplished in a fashion to produce copious mixing of the detergent with the $CO_2$ containing wash fluid prior to exposure of the items to be cleaned. Useful components to this end include but are not limited to static mixers, dynamic mixers, centrifugal pumps, and additional equipment beneficial in providing high shear mixing. The sheared fluid composed of the $CO_2$ wash fluid, water, surfactants, cosolvents and adjuncts is exposed to the articles to be cleaned. Water that cannot be stabilized in the system in the form of an optically clear emulsion, dispersion or solution depletes evenly on fabric surfaces facilitating the dissolution of water-soluble soils. The formulations are typically used at levels between 0.1 and 10% of the total wash fluid volume and preferably between 0.2 and 2.0%.

Cleaning of articles by contact with a liquid composition containing carbon dioxide, water, a surfactant, and an organic cosolvent has been previously disclosed. Injection of water or water and surfactant separate from the $CO_2$ and cosolvent in the present invention has been determined to be advantageous in some cases. Organic cosolvents have been disclosed as solvent modifiers that serve to increase the solvent potential of liquid $CO_2$. Fixing the level of cosolvent in a cleaning system may be desired to control the level of solvency of the primarily $CO_2$ containing system. However, flexibility in the addition quantities of water or water and surfactant may be desired based on efforts to control the water content of a given cleaning cycle. Loads primarily composed of hydrophilic fabrics such as cotton and cotton blends can require more water for dissolution of water-soluble soils than loads primarily composed of hydrophobic fabrics such as polyester and other synthetic materials.

It is an additional component of this invention that temperature can be used to control partitioning of water from the bath to items to be cleaned or conversely from the items cleaned to the bath. The "tunable" nature of liquid and supercritical carbon dioxide is well known. The solubility of water in $CO_2$ varies considerably as a function of temperature. With this feature the aqueous detergent can be injected to the machine at a temperature between 65 and 80° F. where water solubility is relatively low, throughout the cleaning cycle the temperature of the fluid can be lowered to increase the solubility of the water in the bath. Water at the surfaces of the items will then partition into the bath. Conversely, the detergent can be injected into the wash fluid at a lower temperature where solubility is higher and the temperature can be raised to lower water solubility, resulting in partitioning of water from the bath to the fabric throughout the wash cycle.

Figure 2:
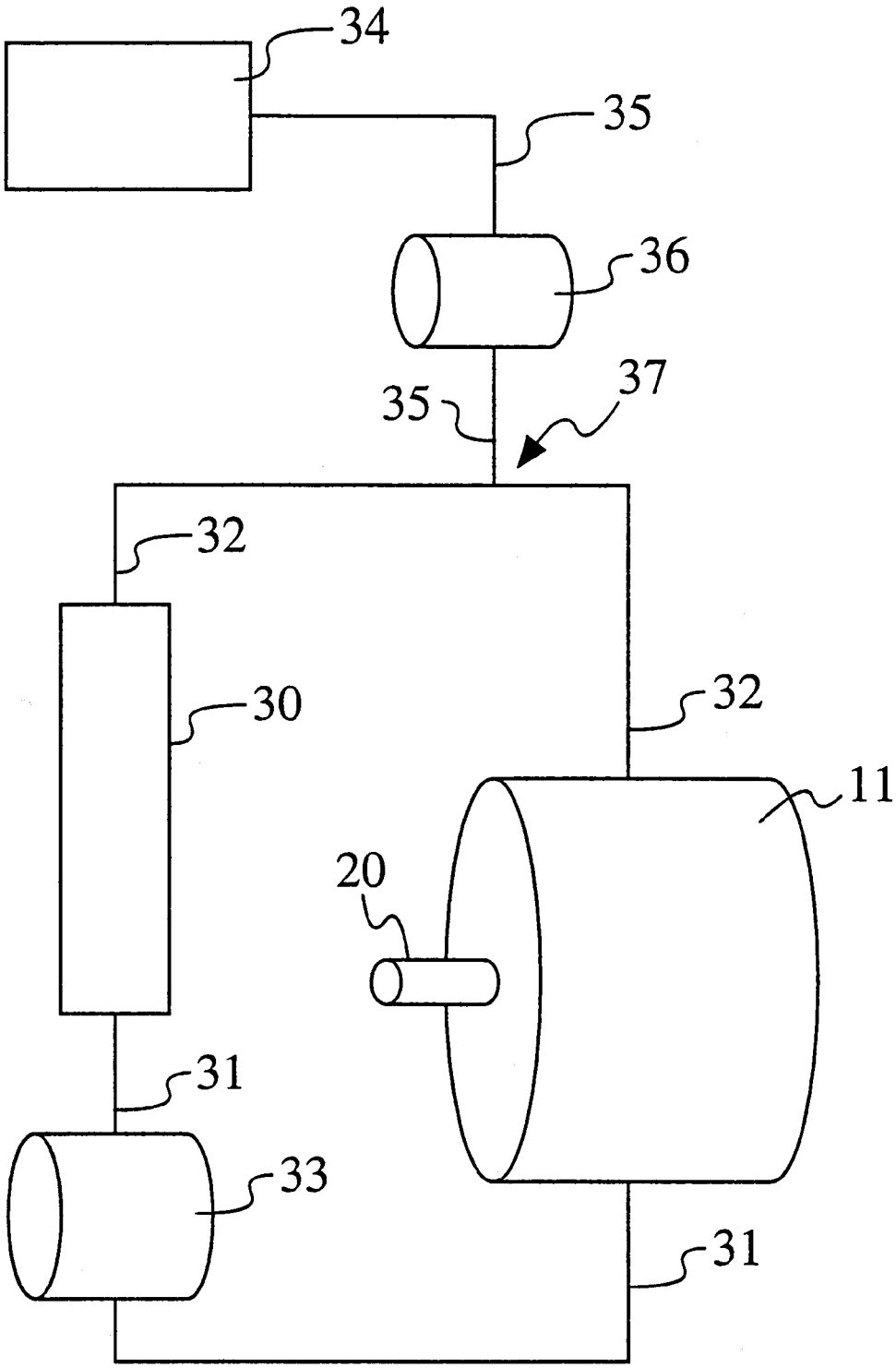
FIG. 2 schematically illustrates an apparatus for the introduction of detergent formulations into a carbon dioxide dry cleaning apparatus under turbulent conditions.

A system for the addition of aqueous (or nonaqueous) detergent formulations and the like to a carbon dioxide dry cleaning system under turbulent or high shear conditions is disclosed in FIG. 2. The system comprises a high pressure wash vessel 11 and a drive means 20 as described in connection with FIG. 1 above. In addition, the system includes a filter 30, a carbon dioxide cleaning solution drain line 31 interconnecting the wash vessel to the filter a carbon dioxide cleaning solution supply line 32 connecting the filter to the wash vessel, and a high pressure pump 33 operably connected to the drain line. The filter may be a lint filter and/or carbon filter, or any other suitable filter.

A detergent formulation reservoir 34 is provided, with a detergent formulation supply line 35 connecting the reservoir to the carbon dioxide cleaning solution supply line. A second high pressure pump 36 operably connected to the detergent formulation supply line is provided to transfer detergent formulation from the detergent formulation reservoir into the carbon dioxide cleaning solution under high shear conditions.

High pressure pumps simply refer to pumps that are capable of pumping liquid carbon dioxide. The closed system and maintaining the temperature below 31 degrees Centigrade ensures that the $CO_2$ remains liquid. Impeller pumps (or centrifugal or rotating vane pumps), suitable for the first high pressure pump, do not operate under conditions where there can be significant differential pressures across the pump. Where their is a significant pressure differential across the pump (as in the second high pressure pump), such pumps are typically positive displacement pumps such as piston pumps or diaphragm pumps.

In an alternative embodiment, the detergent formulation supply line 35 could be connected to the drain line 31, but the detergent formulation would then pass through the filter and potentially be depleted on the filter. In operation, the aforesaid apparatus provides a method of adding a detergent formulation to a carbon dioxide dry cleaning system. In operation, a continuous stream of liquid carbon dioxide cleaning solution is pumped from the wash vessel through the filter and back to the wash vessel to clean articles in the wash vessel, and the detergent formulation is added into the continuous stream of liquid carbon dioxide at a point downstream of the filter and upstream of the wash vessel at junction 37 to introduce the detergent formulation. Since pumping of the continuous stream by the first pump 33 is preferably carried out at a rate of about 10 or 20 to 200 or 300 gallons per minute, turbulence will occur at least a junction 37 when the detergent formulation is pumped into the stream. Those skilled in the art will appreciate how to specifically configure size and shapes of the pipes and the rate of pumping of the detergent formulation and continuous stream to facilitate turbulence and corresponding mixing.

Figure 3:
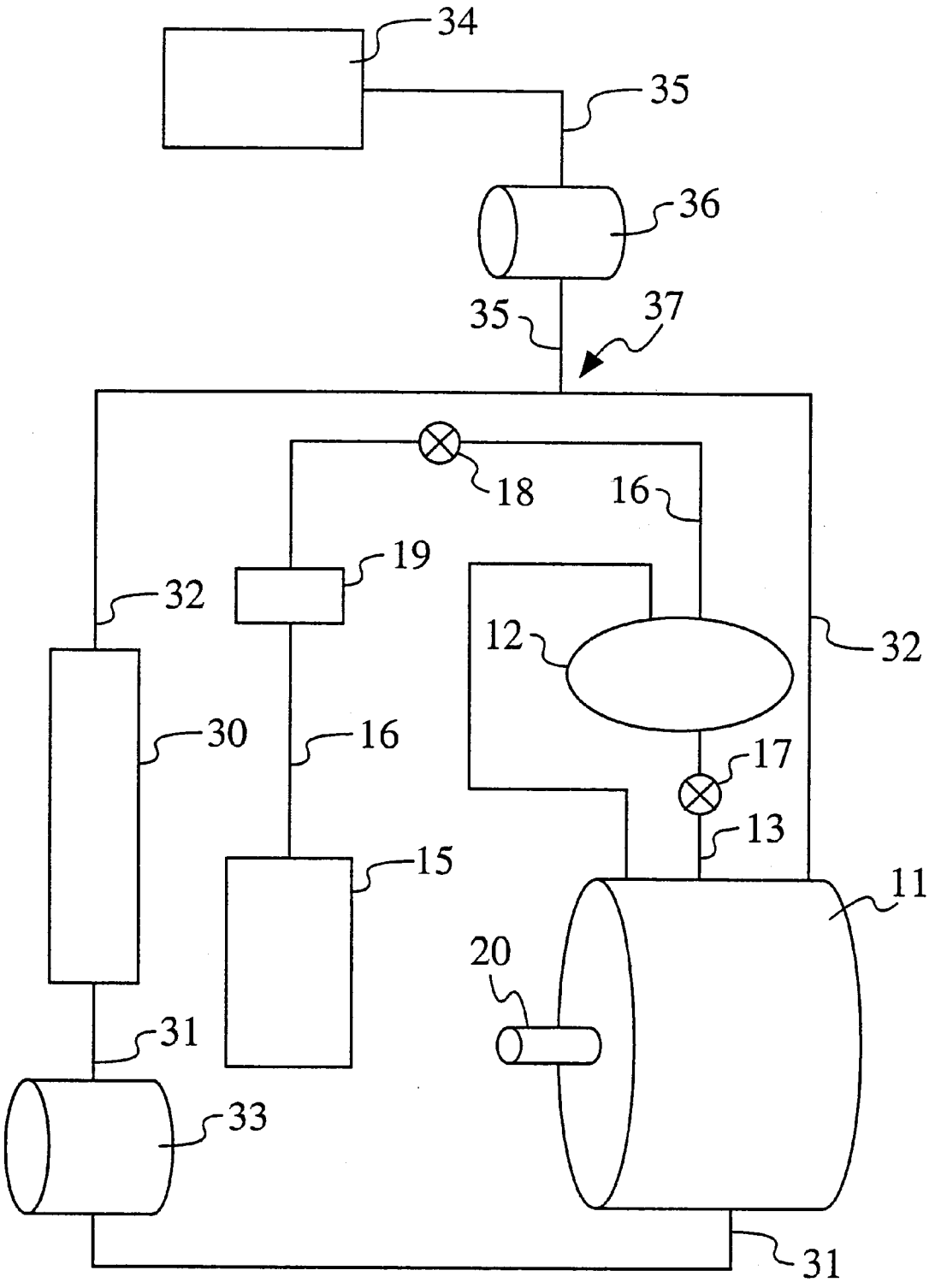
FIG. 3 illustrates a combined apparatus which separately provides for both the controlled introduction of detergent formulations into the wash vessel of a carbon dioxide cleaning apparatus, and for the introduction of detergent formulations into the carbon dioxide dry cleaning apparatus under turbulent conditions.

FIG. 3 represents an apparatus that employs both the system described in FIG. 1 and the system described in FIG. 2. Since many cleaning operations incorporate different types of surfactants, some of which may be maintained in the carbon dioxide liquid in significant quantities from wash to wash and others of which may be depleted onto the articles to be cleaned and/or the filters from wash to wash, the combination of both types of detergent formulation addition systems is advantageous, particularly where different formulations are added through each addition system. Like parts in FIG. 3 are assigned like numbers as compared to FIGS. 1 and 2 above.

8. Cleaning.

The details of the overall cleaning process will depend upon the particular apparatus employed, as discussed in greater detail above. In practice, in a preferred embodiment of the invention, an article to be cleaned and a liquid dry cleaning composition as given above are combined in a closed drum. The liquid dry cleaning composition is preferably provided in an amount so that the wash vessel contains both a liquid phase and a vapor phase (that is, so that the drum is not completely filled with the article and the liquid composition). The article is then agitated in the vessel, preferably so that the article contacts both the liquid dry cleaning composition and the vapor phase, with the agitation carried out for a time sufficient to clean the fabric. The cleaned article is then removed from the drum. The article may optionally be rinsed (for example, by removing the composition from the drum, adding a rinse solution such as liquid $CO_2$ (with or without additional ingredients such as water, co-solvent, etc.) to the drum, agitating the article in the rinse solution, removing the rinse solution, and repeating as desired), after the agitating step and before it is removed from the drum. The dry cleaning compositions and the rinse solutions may be removed by any suitable means, including both draining and venting.

The present invention is explained in greater detail in the following non-limiting examples.

EXAMPLE 1

Nonaqueous Detergent Formulation

An example of an essentially nonaqueous liquid carbon dioxide dry cleaning system that can be used to carry out the present invention is a mixture that contains:

4.2% ISOPAR M™ organic solvent;

0.24% water;

0.196% TRITON™ RW-20 (commercial detergent available from Union Carbide; a secondary amine ethoxylate);

0.048% TRITON™ GR-7M detergent (a commercial detergent of Union Carbide; sodium dioctyl sulfosuccinate in aromatic and aliphatic hydrocarbons); and 0.48% TERGITOL™ 15-S-3 detergent (a commercial detergent of Union Carbide; a secondary alcohol ethoxylate; and carbon dioxide to balance.

The formulation (all ingredients except carbon dioxide) is added to the liquid carbon dioxide by adding it to the wash tank through an auxiliary vessel as described in connection with FIG. 1 above. Thus, for example, the concentration of the ingredients in the mixture contained in the auxiliary vessel would be: 85.7% ISOPAR M™ solvent; 4.5% water; 0.90% TRITON™ RW-20 detergent; 0.90% TRITON™ GR-7M detergent; and 0.80% TERGITOL™ 15-S-3 surfactant.

EXAMPLE 2

Nonaqueous Detergent Formulation

An additional example of a liquid carbon dioxide dry cleaning system that can be used to carry out the present invention is a mixture that contains:

3.07% ISOPAR M™ organic solvent;

1.32% DPMA (diopropylene glycol monomethyl ether acetate);

0.087% water;

0.023% TRITON™ GR-7M detergent (a commercial detergent of Union Carbide; sodium dioctyl sulfosuccinate in aromatic and aliphatic hydrocarbons); and 0.5% TERGITOL™ 15-S-3 detergent (a commercial detergent of Union Carbide; a secondary alcohol ethoxylate); and carbon dioxide to balance.

The formulation (all ingredients except carbon dioxide) is added to the liquid carbon dioxide by adding it to the wash tank through an auxiliary vessel as described in connection with FIG. 1 above. Thus, for example, the concentration of the ingredients in the mixture contained in the auxiliary vessel would be: 61.4% ISOPAR M™ solvent; 26.4% DPMA, 1.74% water; 0.46% TRITON™ GR-7M detergent; and 10.0% TERGITOL™ 15-S-3 surfactant.

EXAMPLE 3

Aqueous Detergent Formulations

A series of different aqueous detergent formulations suitable for liquid carbon dioxide dry-cleaning are given as Examples A through F below. Percentages are given as Percent volume/volume.

Formulation A

95% water;

3% TERGITOL 15-S-3™ surfactant;

1% TERGITOL 15-S-7™ surfactant; and

1% Dipropylene glycol monobutyl ether.

Formulation B

65% water;

30% ISOPAR M™ organic solvent;

3% TERGITOL 15-S-3™ surfactant;

1% TERGITOL 15-S-7™ surfactant;

0.50% AOT surfactant; and 0.50% TERGITOL 15-S-15™ surfactant.

Formulation C 95.5% water;

3% TERGITOL 15-S-3™ surfactant;

0.25% TERGITOL 15-S-15™ surfactant;

0.25% TERGITOL TMN-6™ surfactant; and 1.5% Cetyltrinethylammonium chloride.

Formulation D 65.75% water;

25% ISOPAR M™ organic solvent;

5% hexylene glycol;

3.0% TERGITOL 15-S-3™ surfactant;

1.0% 3-Dodecyldimethylamminiopropane-1-sulfonate;

0.25% TERGITOL TMN-6™ surfactant.

Formulation E

96% water;

2% TERGITOL 15-S-3™ surfactant; and

2% TERGITOL 15-S-7™ surfactant.

Formulation F

94% water;

3% Dipropylene glycol monobutyl ether;

2% TERGITOL 15-S-7™ surfactant; and

1% PDMS-g-PEG (polydimethyl siloxane-graft-polyethylene glycol copolymer) (500 g/mol PDMS with 350 g/mol PEG).

EXAMPLE 4

Addition of Aqueous Detergent Formulation A 1.0 liters of a formulation such as that described in Formula A in Example 3 is injected into a $CO_2$ based dry cleaning machine with a liquid volume of approximately 80 gallons such that the formulation is fed to the low pressure side of a centrifugal pump. The pump is used primarily to transfer fluid from storage to the cleaning wheel and back, and to circulate the cleaning fluid through appropriate filters and heat exchangers. In this case the pump also serves to mix and shear the added detergent prior its transport to the cleaning vessel. The well-mixed detergent is then carried into the vessel by the flow of the wash fluid and water that cannot be stabilized in the wash fluid is evenly depleted on the garments to facilitate aqueous detergency.

EXAMPLE 5

Addition of Aqueous Detergent Formulation 1.5 liters of a formulation such as that described in Formula B in Example 3 is injected into a $CO_2$ based dry cleaning machine such that the formulation is fed to the high-pressure side of a circulating pump. The detergent is carried by the flow of the wash fluid through a static mixing tube prior to it transport to the cleaning vessel containing articles to be cleaned. The well-mixed detergent is then carried into the vessel and water that cannot be stabilized in the wash fluid is evenly depleted on the garments to facilitate aqueous detergency.

EXAMPLE 6

Addition of Aqueous Detergent Formulation 1.0 liters of a formulation such as that described in Formula F in Example 3 is injected into a $CO_2$ based dry cleaning machine such that the formulation is fed to the high-pressure side of a circulating pump. The temperature of the bath during the injection of the detergent is 70° F. Throughout the cycle the temperature of the bath is lowered to 50° F. by the end of the cleaning cycle.

EXAMPLE 7

Addition of Aqueous Detergent Formulation 1.0 liters of a formulation such as that described in Formula E in Example 3 is injected into a $CO_2$ based dry cleaning machine such that the formulation is fed to the low-pressure side of a centrifugal pump. The wash fluid in the system is composed of approximately 95% liquid $CO_2$ and 4% of an organic co-solvent. The sheared mixture is then carried into the cleaning vessel where the bath temperature is 45° F. Throughout the cycle the temperature of the bath is raised to 70° F.

The foregoing is illustrative of the present invention, and is not to be construed as limiting thereof. The invention is defined by the following claims, with equivalents of the claims to be included therein.

That which is claimed is:

1. A method for the controlled addition of a low-water content detergent formulation to a carbon dioxide dry cleaning system, said method comprising:

providing a carbon dioxide cleaning apparatus comprising a wash vessel and a separate auxiliary vessel;

(a) reducing the pressure in said wash vessel and said auxiliary vessel; then (b) adding a detergent formulation to said auxiliary vessel, said detergent formulation comprising (i) at least 30 percent organic co-solvent, (ii) at least 1 percent surfactant; and (ii) not more than 10 percent water; then (c) increasing the pressure in said wash vessel so that liquid carbon dioxide can be pumped therethrough to clean articles in said wash vessel; and then (d) transferring said detergent formulation from said auxiliary vessel to said wash vessel to facilitate the cleaning of articles therein.

2. A method according to claim 1, wherein said adding and transferring steps are carried out while maintaining gas-side communication between said wash vessel and said auxiliary vessel.

3. A method according to claim 1, wherein said transferring step is carried out by gravity drainage.

4. A method according to claim 1, wherein said adding step is carried out by pumping said detergent formulation into said auxiliary vessel.

5. A method according to claim 1, wherein said pumping step is carried out with a low pressure pump.

6. A method for the addition of aqueous detergent formulations and the like to a carbon dioxide dry cleaning system under turbulent conditions, said method comprising:

(a) providing a carbon dioxide cleaning apparatus comprising a wash vessel and a filter;

(b) pumping a continuous stream of liquid carbon dioxide cleaning solution from said wash vessel through said filter and back to said wash vessel to clean articles in said wash vessel; and (c) adding a detergent formulation into said continuous stream of liquid carbon dioxide at a point downstream of said filter and upstream of said wash vessel to introduce the detergent formulation into said continuous stream, with said detergent formulation comprising (i) at least 20 percent water, and (ii) at least 1 percent surfactant, so that water in said detergent formulation is dispersed in said liquid carbon dioxide prior to entry into said wash vessel, without depletion in said filter.

7. A method according to claim 6, wherein said step of pumping a continuous stream of liquid carbon dioxide is carried out at a rate of about 10 to 300 gallons per minute.

8. A method according to claim 6, wherein said step of pumping a continuous stream of liquid carbon dioxide is carried out at a rate of about 20 to 200 gallons per minute.

9. A method according to claim 6, wherein said adding step is carried out by pumping said detergent formulation into said continuous stream.

10. A method according to claim 6, wherein detergent formulation and said continuous stream are combined under turbulent conditions.

* * * * *